United States Patent [19]

Lung et al.

[11] Patent Number: 4,459,816

[45] Date of Patent: Jul. 17, 1984

[54] HEAT PUMP

[75] Inventors: Hans G. Lung, Bjärred; Lars B. I. Persson, Teckomatorp, both of Sweden

[73] Assignee: Aktiebolaget Electrolux, Stockholm, Sweden

[21] Appl. No.: 241,622

[22] Filed: Mar. 9, 1981

[30] Foreign Application Priority Data

Mar. 17, 1980 [SE] Sweden ..... 8002064

[51] Int. Cl.[3] ..... F25B 39/04; F25B 27/02

[52] U.S. Cl. ..... 62/183; 62/238.6; 62/262; 62/324.1

[58] Field of Search ..... 62/262, 427, 183, 238.6, 62/324.1

[56] References Cited

U.S. PATENT DOCUMENTS

| | | | |
|---|---|---|---|
| 2,795,938 | 6/1957 | Galazzi | 62/183 X |
| 3,500,655 | 3/1970 | Lyons | 62/183 |
| 3,659,432 | 5/1972 | Selhost | 62/262 X |
| 3,989,183 | 11/1976 | Gustafsson | 62/238.6 X |
| 4,246,764 | 1/1981 | Papadakos | 62/183 |
| 4,254,630 | 3/1981 | Geary | 62/238.6 X |
| 4,281,519 | 8/1981 | Spath et al. | 62/238.6 X |

*Primary Examiner*—Lloyd L. King
*Attorney, Agent, or Firm*—Alfred E. Miller

[57] ABSTRACT

A heat pump with a compressor arrangement whose condenser forms a heater for water, and whose evaporator is arranged to be heated by air which by means of a fan in a fan space is blown through the evaporator. An air path for ambient air or an air pass for room air is connected alternatively to the fan space. A control means is arranged between the fan space and two air passes for selective connection of one or the other air pass to the fan space, and with the control means in a first position, the fan is arranged to blow air through an air path with ambient air and through the evaporator for water heating, and with the control means set in another position, the fan blows air through another air path with room air and through the evaporator.

4 Claims, 4 Drawing Figures

HEAT PUMP

The present invention relates to a heat pump having a compressor arrangement in which a condenser forms a heater for water, and the evaporator is so positioned and has to be heated by air which is moved by a fan space adjacent to the evaporator. The air is blown through the evaporator by the fan and air passes are alternately connected to the fan space, either from the ambient air or from room air.

It is known to provide a heat pump with an air heated evaporator. However, the known structures have certain disadvantages, one of which is the formation of frost on the evaporator. In order to avoid this disadvantage, the known constructions using a heat pump in an evaporator are located in a place which is regularly sufficiently warm. Alternatively, the heat pump can be provided with conduits and valves for circulation of hot refrigerant through the evaporator on occasions when defrosting is desired. In addition, an electric heater can be used for defrosting the evaporator.

It is a feature of the present invention to provide a heat pump which has an air heated evaporator, and which can be operated at so low a temperature that the evaporator would normally have a formation of frost thereon, but which is so constructed and arranged that the evaporator can be defrosted by a simple means.

It is a further feature of the present invention to defrost the evaporator by simple means which constitutes a movable flap arranged between the fan space and two air passes for connection at the option of one or the other air pass to the fan space. Thus, with the control means in one position, the fan is arranged to blow air from an air path with ambient air through the evaporator for water heating, and that with the control means set in another position, the fan is arranged to blow air from an air path with room air and through the evaporator.

In order that the invention will be more clearly understood, it will now be disclosed in greater detail with reference to the accompanying drawings, in which.

Figure 1:
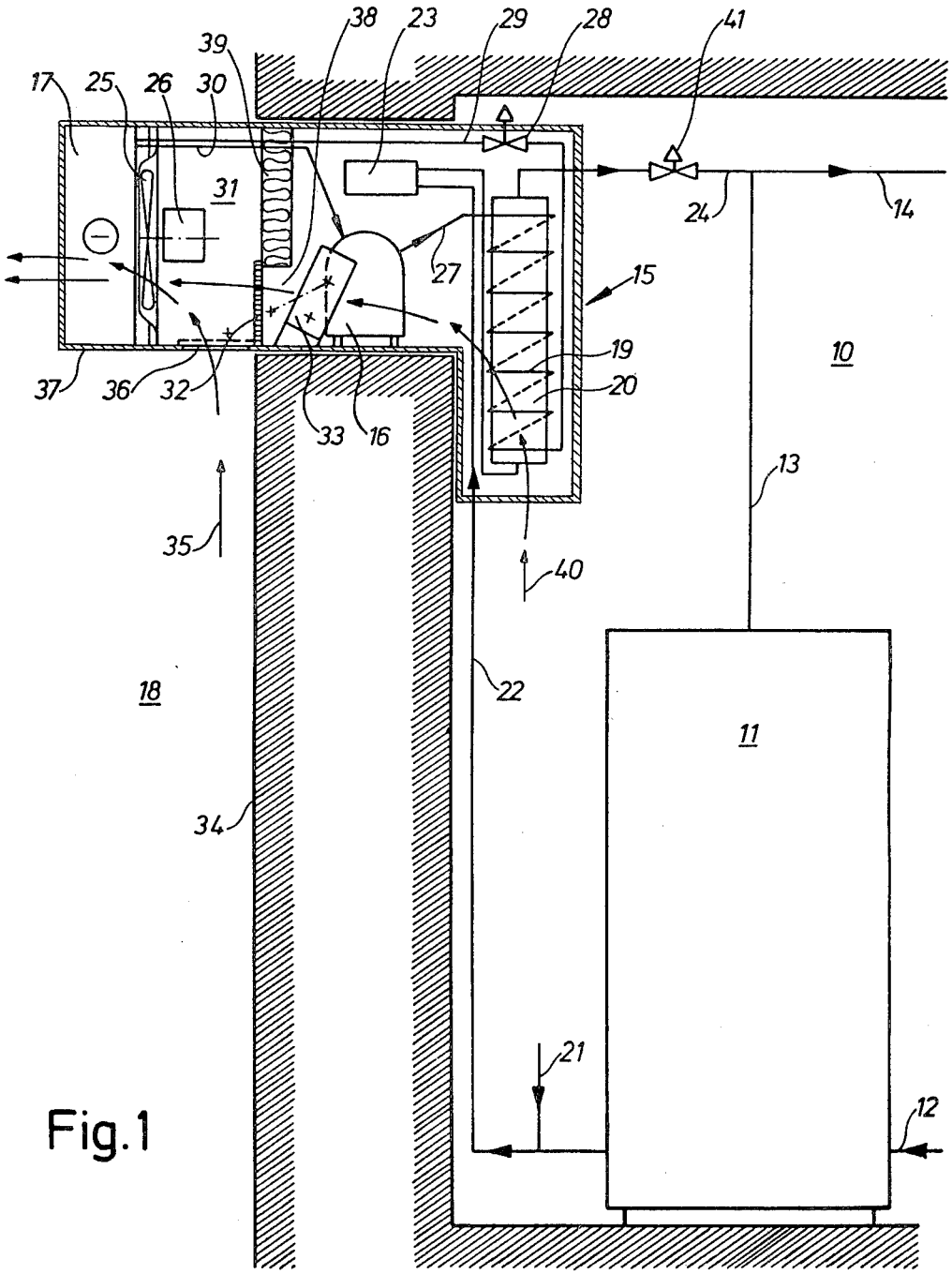
FIG. 1 is a vertical sectional diagrammatic view of the construction embodying the present invention which is taken through a side wall of a room, with a heat pump mounted in the wall.

Referring to FIG. 1, a room 10 is shown having a hot water container 11 therein. The container can comprise a supply of water, a hot water generator, and a heater, for example, an electric heater (not shown) of a known type. The heater in the container is connected to a thermostat which maintains the heater in operation when the water temperature at a given suitable point in the upper part of the container is at a temperature below, for example, 40° C.

The container is provided with a cold water supply conduit 12 and outlet conduits 13 and 14 preferably to the taps. A heat pump 15 is used as a heat source for the container 11 which operates with Freon, for example, and has a compressor 16. The heat pump evaporator 17 is arranged to be heated by outside air, or by air from an unheated chamber 18 adjacent to the room 10. The heat pump condenser 19 is arranged in the room 10 and is in heat exchange or heat conductive contact with a conduit 20 for cold water supplied through a conduit 21 to a circulation system comprising the container 11, a conduit 22 having a water pump 23, the exchanger conduit 20 and a hot water conduit 24 connected between the conduits 13 and 14 from the container 11.

The heat pump 15 contains known components, such as a fan 25 having a motor 26 for blowing air through the evaporator 17, a pressure conduit 27 connected between the compressor 16 and the condenser 19, and a conduit 29 having a capillary or throttle and leading from the condenser to the evaporator 17. A suction conduit 30 is connected from the evaporator 17 to the compressor 16.

A free, intermediate space 31 is located between the evaporator 17 and other components of the heat pump. A pivotable flap 32 is positioned in space 31 which is adapted to move from a vertical position to a horizontal position and vice versa. The flap 32, as shown in FIG. 1 in full lines, permits the fan 25 to blow air from the space 18 outside the wall 34 through the intermediate space 31, and through the evaporator, as shown by the arrows 35. If the flap 32 assumes the dotted line horizontal positioning, an opening 36 in the housing 37 of the heat pump is closed, while an opening 38 in the inner wall 39 of the heat pump is uncovered. In the latter condition, the fan 25 will draw air from the room 10, as indicated by the arrows 40. Furthermore, in this condition the heat pump may be utilized for venting the room 10. Moreover, the same air path can be used for defrosting the evaporator 17, if the same operates at such a low temperature that frost is formed on it. For this purpose a sensor (not shown) may be arranged on the evaporator for directing the motor 33 to pivot the flap 32 to its horizontal position, and the compressor 16 and the water pump 23 to cease operation occasionally when frost is formed, or a low temperature appears on the evaporator. It should also be apparent that a timer can also be used to shift the position of the flap 32.

A modulating valve 41 is provided on the hot water conduit 24 leading from the heat pump 15. The modulating valve is provided with a thermostat for sensing the water temperature and being so adjusted that the hot water has a temperature of at least 50° centigrade. The flow of water is varied and the water temperature set on the thermostat will be maintained at that temperature, depending on the ambient temperature, as well as the temperature of the incoming water and the heat pump capacity.

The circulation of water through the heat pump 15 causes hot water to be supplied to the surface water in the container, which in general contains colder water at the bottom thereof. The container is filled with hot water when the pump operates without tapping of hot water. Furthermore, when the pump operates without tapping of hot water the temperature of the water in the conduit 22 to the heat pump will rise to say 30° C., and a thermostat switch disconnects the heat pump while the water pump still maintains the water flowing in order to reset the switch when the water temperature in the conduit has decreased again.

Figure 2:
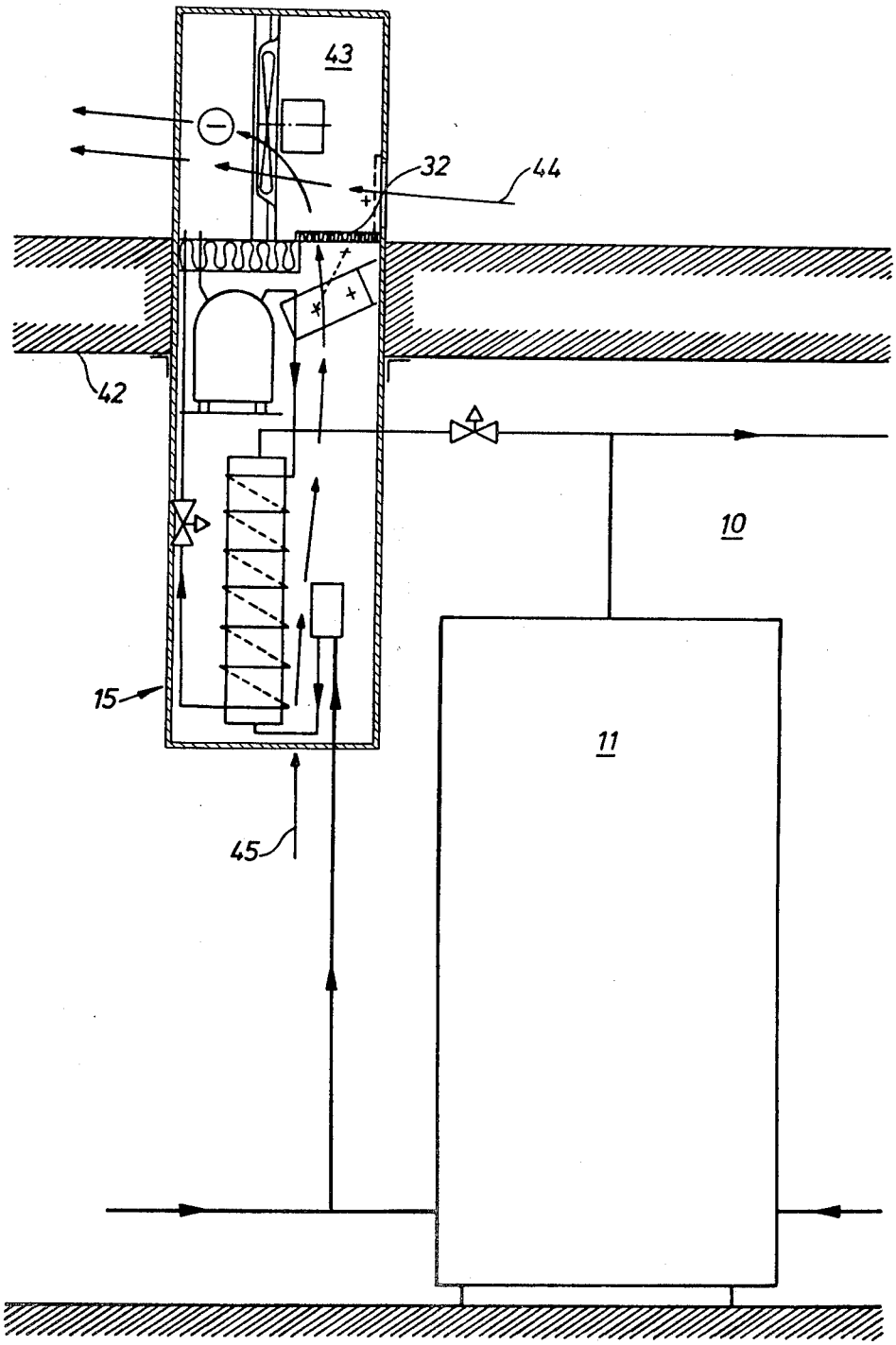
FIG. 2 is a vertical sectional diagrammatic view taken through a top wall or ceiling showing the heat pump mounted therein.

Referring to FIG. 2, the heat pump is shown passing through the top wall or roof 42 of the room 10 in which the container 11 is located. The only essential difference between the structures and arrangements shown in FIGS. 1 and 2 is that the intermediate space 43 of FIG. 2 has another location relative to the components of the heat pump 15. However, the flap 32 determines by its position which air path is open and which is closed. In the present arrangement unheated air is permitted to pass through in the direction of the arrows 44 when the flap 32 is in a horizontal position, and room air to pass through when the flap is in a vertical position, in accordance with the arrows 45.

Figure 3:
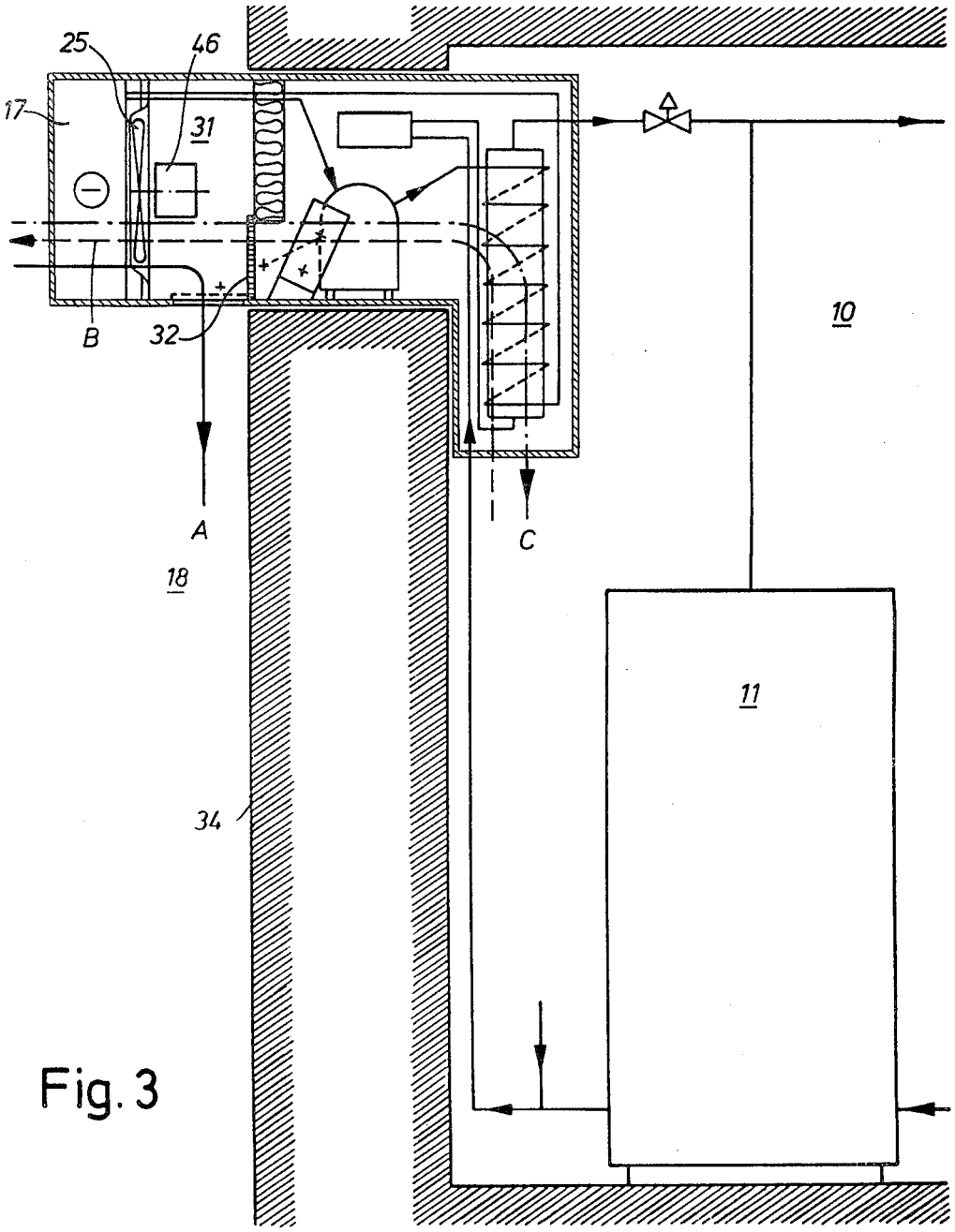
FIG. 3 is a vertical sectional diagrammatic view similar to the view shown in FIG. 1 with a reversible fan motor in the heat pump.

Referring to FIG. 3, the general overall arrangement is similar to that shown and described in connection with FIG. 1. However, the fan motor 46 is of a type which can operate in both directions of rotation. Thus, the fan 25 is arranged during water heating in the heat pump to blow ambient air in a direction through the evaporator 17, the intermediate space 31 and either back to the ambient as shown by the arrows A, or into the room 10 in which a container is placed, as shown by the arrows C. In the latter case some cooling of room 10 is obtained.

The heat pump shown in FIG. 3 may be operated with some gain also even with temperatures below zero degrees C. of the air outside the wall 34. Consequently, frost may be formed on the evaporator 17, however this frost may be removed quickly and effectively. The fan 25 is then driven in the other direction and the flap 32 assumes a horizontal position. Consequently, on occasion, air from the room 10 flows out through the evaporator 17, as indicated by the arrows B. It should be evident that the fan can be operated in this manner also in the event that venting of the room 10 is desired.

Figure 4:
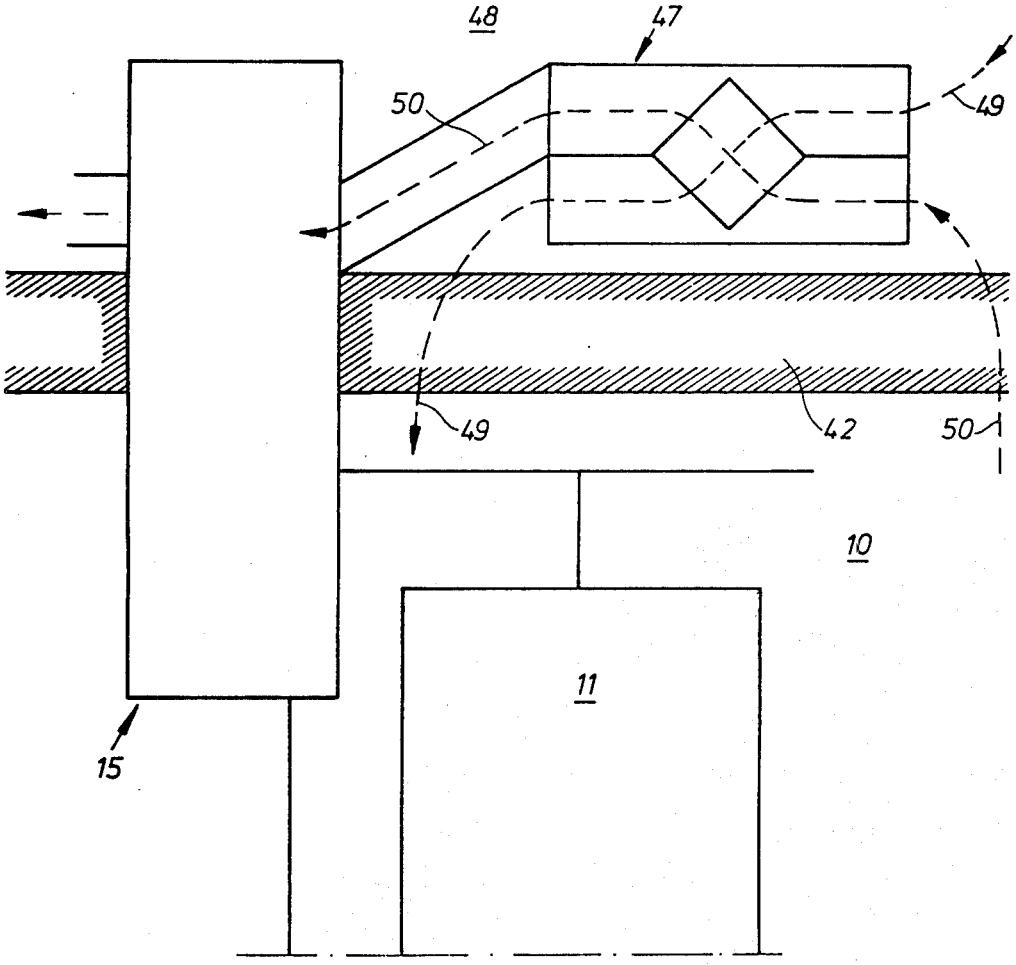
FIG. 4 is a vertical sectional view diagrammatic view similar to that shown in FIG. 3, however with the heat pump connected to an outlet from a heat exchanger.

Referring more particularly to FIG. 4, an arrangement is shown which is similar to that shown in FIG. 2 with a hot water container 11 in a room 10 and a heat pump 15 in the top wall or ceiling 42 of the room 10. In this embodiment a heat exchanger 47 is also used which, for example, is placed in an attic 48. Cold fresh air is sucked in from the outside and conducted through the heat exchanger and into room 10, as shown by the arrows 49. Air from the room 10 is conducted by another path through the heat exchanger 47 and into the heat pump 15 to heat its evaporator. A fan is provided in each flow path and in known manner in heat exchanger 47.

It is to be noted that the construction and arrangement shown in FIG. 4 may be operated all year round. Since the heat pump evaporator is located in an attic and by using a heat exchanger it is possible to avoid the formation of frost. Only one fan is needed in the air path shown by the arrows 50 since the same air passes through the heat exchanger and heats the evaporator in the heat pump. A heat pump constructed according to the teachings of the present invention, with or without a heat exchanger, can be placed for example, in an unheated garage, or in a similar space.

As it will be understood from the above, the heat pump can be used for water heating with advantage. For instance, it can be used for heating tap water or for central heating, or both. It can also be used to heat air. In the latter case the fan is arranged in the air path past the condenser and can be activated by the motor which operates the evaporator fan.

What is claimed is:

1. In a combination heat pump and air conditioner having a compressor system provided with a condenser arranged to be cooled by water in a water heater and an evaporator arranged to be heated by air, a reversible fan positioned in an intermediate fan space, said air being blown by said fan through said evaporator, an air path for ambient air or an air path for room air which are alternately and selectively connected to said fan space, the improvement comprising: said intermediate fan space having separate openings therein constituting said air path for ambient air and said air path for room air, said evaporator being located downstream of said intermediate fan space, a movable control means located between said fan space and said two air paths for connecting selectively one or the other of said air paths to said fan space, and when said control means is in a first position the fan is arranged to blow air from one of the air paths with ambient air through the evaporator and operating in one direction, and when said control means is in a second position said fan blows air from the other of said air paths with room air through said evaporator, with the fan operating in the opposite direction.

2. A combination pump and air conditioner arrangement as claimed in claim 1 wherein said control means is a pivotally mounted flap, and means for pivoting said flap between two positions depending on the selected air path to cover one of said openings and uncover the other of said openings.

3. A combination heat pump and air conditioner arrangement as claimed in claim 2 further comprising an opening in the housing for said fan space closable by said flap, and when said flap is in one position said flap is removed from said opening to permit ambient air to move into said fan space.

4. A combination heat pump and air conditioner arrangement as claimed in claim 2 further comprising an inner wall partially separating said fan space from said room, and said flap being pivotable to said one position into engagement with said inner wall and thereby completely separating said fan space from said room and when said flap is pivoted to another position an opening is created for said air path in which room air moves into said fan space.

* * * * *